United States Patent [19]

Kaiser

[11] 4,022,466

[45] May 10, 1977

[54] HOCKEY HELMET ATTACHMENT

[76] Inventor: Thomas A. Kaiser, 19708 Avalon, St. Clair Shores, Mich. 48080

[22] Filed: June 11, 1976

[21] Appl. No.: 695,241

[52] U.S. Cl. ..... 273/1 B; 2/9; 2/10; 2/442; 2/445

[51] Int. Cl.[2] ..... A63B 69/00; A63B 71/10

[58] Field of Search ..... 273/1 B, 1.5 A; 2/9, 2/10, 422, 425

[56] References Cited

UNITED STATES PATENTS

| | | | |
|---|---|---|---|
| 2,850,740 | 9/1958 | Adams | 2/9 |
| 3,166,761 | 1/1965 | Strohm | 2/9 X |
| 3,779,549 | 12/1973 | MacNeil | 273/1 B |
| 3,783,450 | 1/1974 | O'Connor | 2/425 X |
| 3,868,108 | 2/1975 | Kirchner | 273/1.5 A |

*Primary Examiner*—Paul E. Shapiro

*Attorney, Agent, or Firm*—Gifford, Chandler, Sheridan & Sprinkle

[57] ABSTRACT

An attachment for a hockey helmet is provided which, when attached, obstructs the downwardly extending vision of the helmet wearer. The attachment generally comprises a flat arcuate member constructed of a flexible and opaque material. The arcuate member is attached to the helmet so that it extends forwardly of the helmet in a generally horizontal plane and below the eye opening of the helmet. Consequently, with the hockey helmet worn on the head of a hockey player, the arcuate member obstructs the downwardly extending vision of the player. Adjustment means are provided for both vertically and horizontally positioning the arcuate member relative to the helmet.

8 Claims, 5 Drawing Figures

HOCKEY HELMET ATTACHMENT

BACKGROUND OF THE INVENTION

I. Field of the Invention

The present invention rlates generally to headwear attachments and, more particularly, to an attachment for a helmet adapted to obstruct the downwardly extending vision of the wearer.

II. Description of the Prior Art

The game of ice hockey is played on a substantially oval ice rink with a goal placed at opposite ends of the rink. During the play of the game, the players move a puck along the ice rink with a hockey stick and attempt to drive the hockey puck into the opponent's goal.

During the game of ice hockey, hockey players often skate along the ice rink while simultaneously moving and retaining control of the puck with the hockey stick. The proper procedure for this hockey movement, commonly known as stick handling, requires that the player move the puck instinctively along the ice without looking downwardly toward the puck. By stick handling the puck without watching it, the player is free to observe the other hockey players about him and thus prevent potentially dangerous collisions between himself and the other players on the rink.

In practice it has been found that novices, and particularly children, in the game of ice hockey have a strong tendency to watch the puck while stick handling due not only to their inexperience at the game, but also to their lack of confidence in their stick handling capabilities. As a result, novice players often collide with other players on the ice rink while stick handling which can, of course, result in serious injury to the hockey players.

Moreover, once the habit of watching the puck while stick handling is firmly established, this undesirable trait is difficult to overcome. Consequently, such hockey players usually reach a plateau in their hockey playing skills and thereafter progress no further.

SUMMARY OF THE PRESENT INVENTION

The present invention overcomes the above mentioned tendency to watch the puck while stick handling by providing an attachment for a hockey helment which obstructs the downwardly extending vision of the player.

In brief, the attachment of the present invention comprises a flat arcuate member constructed of an opaque and preferably flexible material. The arcuate member is attached to the hockey helmet so that the member extends forwardly of the helmet in a generally horizontal plane and below the eyesight of the hockey player. In this manner, the arcuate member acts as a sheild and obstructs the downward vision of the hockey player so that the player is unable to watch the hockey puck while stick handling.

Preferably, the arcuate member is attached to the helmet by means of a L-shaped connecting member. The vertical leg of the connecting member is slidably ajustably received within a bracket attached to the helmet so that the vertical position of the arcuate member relative to the helmet is adjustable. Similarly, the horizontal leg of the connecting member is slidably received in a bore in the arcuate member so that the lateral or horizontal position of the arcuate member is adjustable relative to the helmet. Locking screws maintain the connecting member in its vertically and horizontally adjusted position.

In the above manner, the attachment of the present invention obstructs the downwardly extending vision of the hockey player without obstructing the lateral or forward vision of the player. Consequently, the player cannot watch the puck while stick handling but otherwise his vision is unobstructed.

It will also be understood that the helmet attachment of the present invention is primarily a training device. Thus, once the hockey player has learned to stick handle the puck with the attachment of the present invention it can be removed from the helmet without fear that the player will acquire the undesirable habit of watching the puck while stick handling.

BRIEF DESCRIPTION OF THE DRAWINGS

A better understanding of the present invention will be had upon reference to the following detailed description when read in conjunction with the accompanying drawing wherein like reference characters refer to like parts throughout the several views, and in which.

DETAILED DESCRIPTION OF THE PRESENT INVENTION

Figure 1:
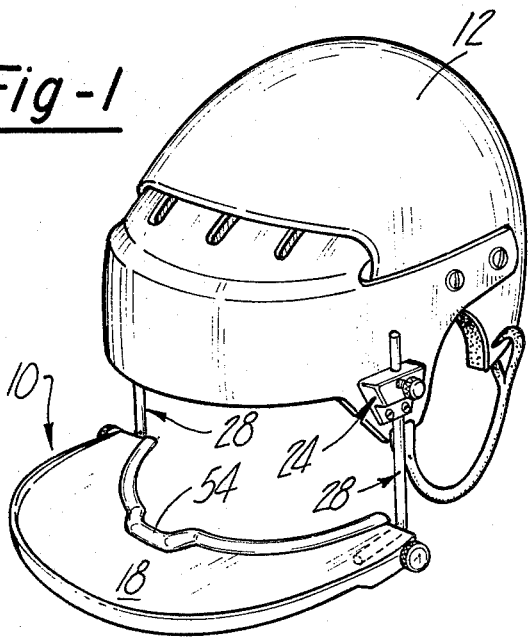
FIG. 1 is a perspective view showing the attachment of the present invention secured to a hockey helmet.
Figure 2:
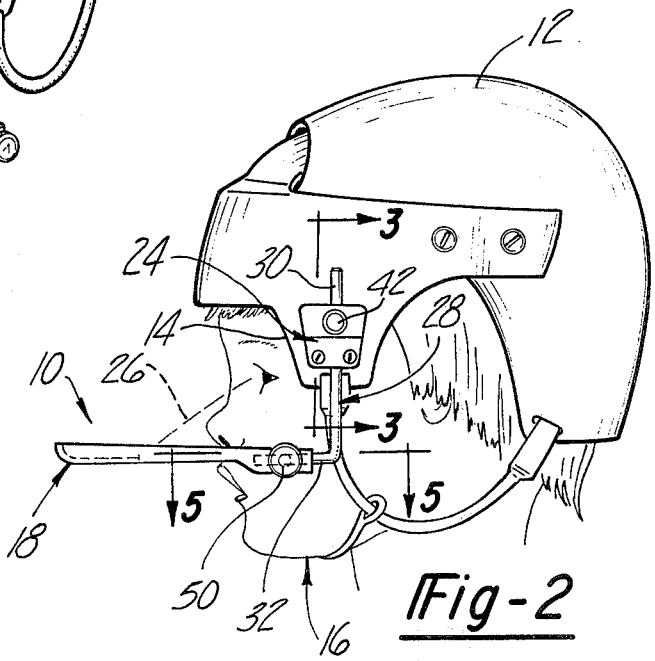
FIG. 2 is a side plan view showing the attachment of the present invention secured to a hockey helmet which in turn is positioned upon a hockey players head.
Figure 4:
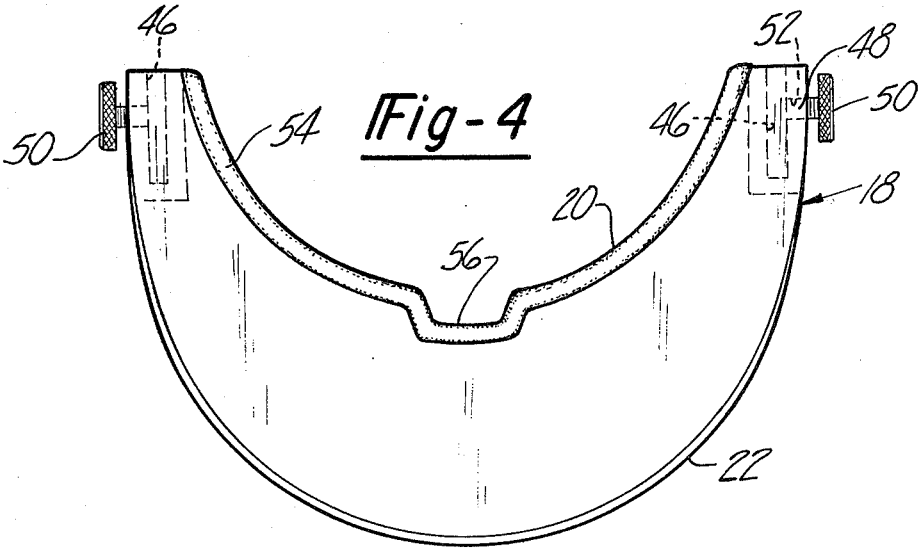
FIG. 4 is a top plan view showing the attachment of the present invention and with parts removed for clarity.

With reference first to FIGS. 1, 2, and 4, the attachment 10 of the present invention is thereshown secured to a hockey helmet 12 in a manner which will be later described in detail. The helmet 12 includes an eye opening 14 on the front part of the helmet 12 and is adpated to be worn on the head of a player 16. It will be appreciated that most hockey leagues for children require the players to wear a helmet 12 in order to protect the child against serious injury.

The attachment 10 generally comprises an arcuate member 18 having an inner arcuate edge 20 adapted to fit around the face of the wearer 16 and an outer arcuate edge 22 of greater diameter than the inner edge 20. The arcuate member 18 is substantially flat and is constructed of an opaque material such as plastic. Moreover, the member 18 is preferably flexible to prevent injury to the player 16 as will be later described.

As best shown in FIG. 2, the member 18 is attached to the helmet 12 by means 24 so that the member 18 extends forwardly from the helmet 12 in a generally horizontal plane and below the eye opening 14 of the helmet 12. With the member 18 thus positioned, the member 18 blocks the downwardly extending line of vision 26 of the player 16.

Figure 3:
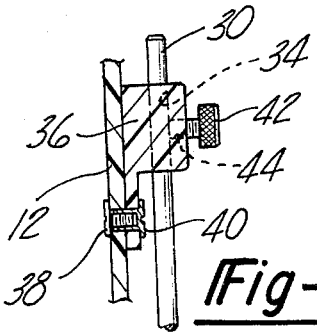
FIG. 3 is a fragmentary partial cross sectional view taken substantailly along line 3—3 in FIG. 2.

Although any conventional means 24 may be used to secure the member 18 to the helmet 12, as best shown in FIGS. 2 and 3, an L-shaped connecting member 28 is positioned between the helmet 12 and the member 18 on each side of the helmet 12 (only one of which is shown). One leg 30 of each connecting member 28 extends in a substantially vertical direction while the other leg 32 of each connecting member 28 extends in a horizontal direction. Each bracket 36 in turn is secured to the helmet 12 by a screw 38 and nut 40 arrangement although any other conventional means can also be used. A thumb screw 42 engages a threaded bore 44 in each bracket 36 which intersects the bore 34 so that upon tightening of the thumb screw 42, the screw 42 abuts against and locks the position of the connecting member vertical leg 30 to the bracket 36 and, consequently, to the helmet 12. In this manner the vertical position of the arcuate member 18 relative to the helmet 12 is adjustable.

Figure 5:
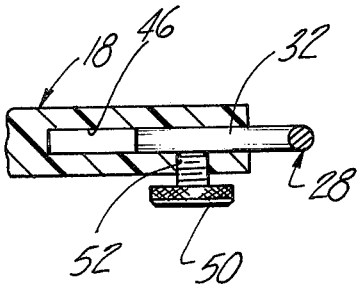
FIG. 5 is a fragmentary cross sectional view taken substantially along line 5—5 in FIG. 2 and enlarged for clarity.

With reference now to FIGS. 2 and 5, the horizontal leg 32 of each connecting member 28 is slidably received within a substantially horizontal bore 46 formed in each tail portion 48 of the arcuate member 18. A thumb screw 50 threadably engages a threaded bore 52 in each tail portion 48 of the member 18 which intersects the bore 46 so that upon tightening of the thumb screw 50, the thumb screw 50 abuts against and locks the position of the connecting member leg 32 within the bore 46.

With reference to FIG. 2, the adjustable means for attaching the connecting member 28 to both the helmet 12 and the arcuate member 18 permits both vertical and horizontal adjustment of the arcuate member 18 relative to the helmet 12. Thus, the attachment 10 of the present invention is adaptable to fit around the face of different players 16.

As best shown in FIGS. 1 and 4, in order to further protect the player 16 against injury from the attachment 10 of the present invention, the inner arcuate edge 20 of the the member 18 is covered with a padded strip 54, such as foam rubber or the like. The padded strip 54, abuts against the face of the player 16 to protect the player 16 against harm from the arcuate member 18. In addition, if desired, the inner arcuate edge 20 may include a notch 56 to fit around the nose of the player 16.

In operation with the helmet 12 attached to the head of the player 16, the legs 30 and 32 of each connecting member 28 are inserted into their respective bores in the bracket 36 and in the arcuate member 18. The position of the arcuate member 18 is then adjusted horizontally until the inner edge 20 abuts the players face and vertically until the downwardly extending vision of the player 16 is obstructed. When properly positioned, the thumb screws 50 and 42 are tightened thus locking the member 18 to the helmet 12.

While playing hockey, the arcuate member 18 serves as a shield to obstruct the player's downwardly extending vision. As a result, the player is unable to watch the puck when stick handling and rather will observe the rink and the other players around him in the correct and desired fashion.

It can thus be seen that the attachment 10 of the present invention provides a novel training device for the sport of ice hockey which prevents the player 16 from watching the hockey puck while stick handling. Moreover, both the padded strip 54 and the flexibility of the arcuate member 18 prevents injury to the player 16 in the event that the attachment 10 is struck by another player, the ice rink, or other objects within the ice rink.

Having thus described my invention many modifications thereto will become apparent to those skilled in the art to which it pertains without deviation from the spirit of the invention as defined by the scope of the appended claims.

I claim:

1. An attachment for a helmet having an eye opening and adapted to be worn on the head comprising:

a flat member constructed of an opaque material, and means for mounting said member to said helmet so that said member extends forwardly of said helmet in a substantially horizontal plane and below the eye opening of said helmet to thereby obstruct the downwardly extending vision of a wearer of said helmet.

2. The attachment as defined in claim 1 wherein said member further comprises an inner arcuate edge adapted to fit around the face of the wearer of the helmet.

3. The attachment as defined in claim 2 wherein said member includes an outer arcuate edge extending forwardly of said inner arcuate edge.

4. The attachment as defined in claim 2 and including a padded strip secured along the inner arcuate edge of said flat member.

5. The attachment as defined in claim 2 and including a notch in said inner arcuate edge adpated to fit around the nose of the wearer.

6. The attachment as defined in claim 1 wherein said means further comprises á connecting member, means for attaching one end of said connecting member to said helmet and means for attaching the other end of said connecting member to flat member.

7. The attachment as defined in claim 6 wherein said connecting member includes a vertically elongated portion and wherein said means for attaching said connecting member to said helmet further comprises a bracket secured to said helmet and having a vertical bore formed therethrough, wherein said connecting member vertically elongated portion is slidably disposed in said vertical bore, and means for locking said connecting member to said bracket.

8. The attachment as defined in claim 6 wherein said connecting member includes a horizontally elongated portion slidably disposed in a horizontal recess in said flat member and means for locking said connecting member horizontal portion within said recess.

* * * * *